US008056480B2

(12) United States Patent
Brydges-Price

(10) Patent No.: US 8,056,480 B2
(45) Date of Patent: Nov. 15, 2011

(54) PROJECTILE FOR ADMINISTERING A MEDICAMENT

(76) Inventor: Richard Ian Brydges-Price, York (GB)

( * ) Notice: Subject to any disclaimer, the term of this patent is extended or adjusted under 35 U.S.C. 154(b) by 142 days.

(21) Appl. No.: 12/305,186

(22) PCT Filed: Jun. 15, 2007

(86) PCT No.: PCT/GB2007/002250

§ 371 (c)(1),
(2), (4) Date: Dec. 16, 2008

(87) PCT Pub. No.: WO2007/144655

PCT Pub. Date: Dec. 21, 2007

(65) Prior Publication Data

US 2009/0193996 A1 Aug. 6, 2009

(30) Foreign Application Priority Data

Jun. 16, 2006 (GB) ..... 0612020.8
Jul. 20, 2006 (GB) ..... 0614407.5

(51) Int. Cl.
*F42B 12/54* (2006.01)
*A61M 5/20* (2006.01)

(52) U.S. Cl. ..... 102/502; 102/512; 604/130

(58) Field of Classification Search ..... 102/502, 102/512; 604/130
See application file for complete search history.

(56) References Cited

U.S. PATENT DOCUMENTS

| | | | | |
|---|---|---|---|---|
| 2,620,190 | A | 12/1952 | Bean | |
| 3,386,381 | A * | 6/1968 | Ferb | 102/512 |
| 3,457,921 | A * | 7/1969 | Waldeisen | 604/130 |
| 3,502,025 | A * | 3/1970 | Payne | 102/512 |
| 3,616,758 | A * | 11/1971 | Komarov | 102/512 |
| 3,995,550 | A | 12/1976 | D'Amico, Jr. | |
| 4,243,036 | A | 1/1981 | Ott | |
| 6,375,971 | B1 | 4/2002 | Hansen | |
| 6,584,910 | B1 * | 7/2003 | Plass | 102/512 |
| 2003/0159612 | A1 * | 8/2003 | Ziemack | 102/512 |
| 2006/0086280 | A1 * | 4/2006 | Duong | 102/502 |

FOREIGN PATENT DOCUMENTS

| | | | |
|---|---|---|---|
| CH | 570 156 | A5 | 10/1975 |
| DE | 29 32 669 | A1 | 8/1979 |
| EP | 0 049 068 | A1 | 4/1982 |
| FR | 2800867 | A1 | 5/2001 |
| GB | 2 346 201 | A | 8/2000 |
| WO | 00/48653 | A1 | 8/2000 |

* cited by examiner

*Primary Examiner* — James Bergin

(74) *Attorney, Agent, or Firm* — Knobbe, Martens, Olson & Bear, LLP

(57) ABSTRACT

A projectile (2) includes a cylindrical casing with the one (nose) end has a relatively non-penetrating front face (3) with an opening therein defining a cavity (5) extending longitudinally into the casing from said opening, and the other (tail) end (10) of the cylindrical casing is adapted to receive a propelling force; said projectile further comprises an implant (14) for penetrating a target on impact; wherein said implant is located at least in part within the cavity during flight and has longitudinal freedom of movement within the cavity towards the nose of the casing; whereby on impact said implant tends to penetrate said target whilst said relatively non-penetrating front face abuts at least momentarily said target.

31 Claims, 8 Drawing Sheets

PROJECTILE FOR ADMINISTERING A MEDICAMENT

This application is U.S. National Phase of International Application PCT/GB2007/002250, filed Jun. 15, 2007 designating the U.S., and published in English as WO 2007/144655 on Dec. 21, 2007, which claims priority to Great Britain Patent Applications No. 0612020.8, filed Jun. 16, 2006 and No. 0614407.5, filed Jul. 20, 2006.

FIELD OF THE INVENTION

This invention relates to a projectile for the delivery of a payload for implanting into a target. In a preferred embodiment the target is an animal and the payload may comprise an implant designed to administer a medicament dosage, or a marker, or a tracking device. The term medicament is to be interpreted broadly throughout this specification. It will include for example an anaesthetic, a contraceptive, a worming compound, a growth promoter, a supplement, a pharmaceutical composition, therapeutic, and/or prophylactic agents which are envisaged in specific embodiments of the invention.

BACKGROUND TO THE INVENTION AND PRIOR ART KNOWN TO THE APPLICANT

When administering a medicament dosage, a marker or a tracking device to cattle it is often necessary to herd the cattle to a particular station for administrating a medicament dosage, a marker, or a tracking device. During this process the cattle goes through intense exertion which results in considerable weight loss which can only be recovered through intensive feeding of several thousands of calories. There is therefore a need to administer cattle with minimal herding requirement. There is also a requirement to implant a medicament or a tracking device through the hide and into the sub-cutaneous flesh at 2-3 inches whilst leaving less tissue and muscle damage than conventional administering methods.

The following prior art documents are acknowledged:

U.S. Pat. No. 6,807,908, GB2346201, U.S. Pat. No. 4,243,036, FR2800867 and U.S. Pat. No. 3,995,550.

U.S. Pat. No. 6,807,908 is concerned with retarding the velocity of a projectile impact to prevent excessive damage, injury or penetration at the target by using an inflatable membrane. The needle is fixed relative to the casing to the projectile so that the needle has no longitudinal freedom of movement within the cavity towards the nose of the casing.

GB2346201 discloses a marking projectile, which is of a non-penetrating kind. There is no implant member suggested for the delivery of a payload.

U.S. Pat. No. 4,243,036 incorporates a penetrating needle which is fixed relative to a syringe casing. This system employs a projectile brake to prevent excessive penetration of the needle.

FR2800867 fails to show any form of penetration since it is destined to project a liquid over an object rather than into an object.

U.S. Pat. No. 3,995,550 disclosed a spinning artillery projectile which has no relatively non-penetrating front face and has no implant of the kind in question for this invention.

An object of the invention is to provide a projectile, which serves to deliver and implant a payload with the minimum of damage and discomfort to an animal target.

SUMMARY OF THE INVENTION

In a first broad independent aspect, the invention provides a projectile including a cylindrical casing with the one (nose) end having a relatively non-penetrating front face with an opening therein defining a cavity extending longitudinally into the casing from said opening, and the other (tail) end of the cylindrical casing being adapted to receive a propelling force; said projectile further comprising an implant for penetrating a target on impact, wherein said implant is located at least in part within the cavity during flight and has longitudinal freedom of movement within the cavity towards the nose of the casing; whereby on impact said implant tends to penetrate said target whilst said relatively non-penetrating front face abuts at least momentarily said target.

This configuration is particularly advantageous because it allows an implant to penetrate the hide and/or the sub-cutaneous layer of an animal whilst causing minimal tissue and/or muscle damage. It avoids having to herd cattle to a station for the administration of medicaments to animals.

In a subsidiary aspect in accordance with the invention's first broad independent aspect, said implant is separable from said casing. This allows the casing to rebound on the target without penetrating the target whilst the implant penetrates the target and applies a medicament, a tracking function or a marker.

In a further subsidiary aspect, said implant incorporates a hollow portion containing a payload. This configuration is particularly advantageous because it allows the payload to be transported by the implant itself, which marks a complete departure from the prior art teaching of having a separate needle and payload storage compartment.

In a further subsidiary aspect, said implant is substantially made of a medicament and a binding compound. This is particularly advantageous because it allows the implant to penetrate into an animal and thereafter dissolve into the animal's organism as a medicament. There is also no need for a separate payload and container for the payload.

In a further subsidiary aspect, said implant incorporates a tip which is substantially frusto-conical. This configuration is particularly advantageous because it allows improved penetration as compared to the truncated end of a needle.

In a further subsidiary aspect, said tip incorporates a forward most portion, which is frusto-conical and a second portion, which is frusto-conical located behind said forward most portion, which has a lower angle than the angle of said forward most portion. This configuration is particularly advantageous because it improves the penetration of the implant whilst reducing tissue damage on the animal target.

In a further subsidiary aspect, said implant incorporates a tail, a tip and a body located between said tail and said tip; said body being tapered so that the body is wider in the vicinity of its tip than it is at its tail. This configuration improves distribution for penetration into the target.

In a further subsidiary aspect, a disc sits between the tip and the nose of said casing and said implant incorporates a tail, which projects sideways in order to abut against said disc as the implant separates against said casing. This configuration is particularly advantageous since it allows the implant to be limited with regards to its potential penetration depth.

In a further subsidiary aspect, said disc is a marker. This allows the disc to serve a dual function of controlling the depth of penetration as well as marking the animal. In a further subsidiary aspect, said projectile incorporates a dye or a brightly visible disc.

In a further subsidiary aspect, said disc incorporates an antiseptic compound. In a further subsidiary aspect, said projectile or said disc incorporates an insect repellent or other medication. This configuration is particularly advantageous because it also allows the damage caused by the implant to heal rapidly.

In a further subsidiary aspect, a tether extends between said casing and said implant. This configuration is particularly advantageous because it allows the depth of the implant within the target to be controlled by the length of the tether.

In a further subsidiary aspect, said tether is biodegradable. This would allow the organism of the animal to biodegrade the tether once it has fulfilled its function of controlling the depth of penetration of the implant.

In a further subsidiary aspect, said implant is biodegradable. This would allow the animal's organism to dissolve the implant once it has received the benefit of the medicament of the implant.

In a further subsidiary aspect, said casing is biodegradable. This would have the additional advantage that when the casing is lost it may be biodegraded without causing any harm.

In a further subsidiary aspect, the tail end of the casing is adapted for connection with a propellant charge case or a pneumatic system.

According to a second broad independent aspect, there is provided a projectile including a cylindrical casing with the one (nose) end having a planar front face surface with an opening therein defining a cavity extending longitudinally into the casing from said opening, a payload located within the cavity bearing against the cavity base and supported laterally by the cavity wall, the other (tail) end of the cylindrical casing being adapted to receive a propelling force and being preferably adapted for connection with a propellant charge case.

The payload will have longitudinal freedom of movement within the cavity towards the nose of the casing, such that following impact the payload continues forward through inertia.

An alternative embodiment uses a small gas producing means initiated on impact with a target to assist in the forward inertia based movement of the payload.

The casing preferably includes a drive band or bands serving to cooperate with the rifling of a barrel to impart spin to the projectile and to form an obturating means. The projectile may be sub-calibre supported by a propulsive cage or discarding sabot. In an embodiment the projectile is integrated with a propellant charge containing cartridge casing conveniently of twelve gauge.

In a preferred embodiment the payload comprises an elongate pellet or container with a pointed forward end and either comprising or adapted to house an implant. The pellet may be an medicament or a tracking means. Alternatively the container may house such means and preferably will itself be soluble in the target medium.

The payload may have a diameter less than that of the cavity and be laterally supported therein by a cage, of plastics for example, or by a powder or granular material. This material may include a marker dye and be of a kind, which is "fluidised" through energy release on impact of the projectile. This property being exhibited by finely comminuted materials such as "flour". Viscous fluid materials may be used of the kind, which fluidise on energy release being of a "thixotropic" nature. Alternatively, the payload outer surface may bear directly against the cavity wall with or without an interposed layer of, for example, a friction reducing material or like.

In a further preferred embodiment the tail of the payload has an integral laterally extending base portion and the opening in the casing is reduced in diameter by an annular inturned rim portion. In an alternate arrangement the base is a separate insert of a heavy material. The arrangement being such that on target impact, and through inertia, the payload may pass through the reduced diameter opening in the casing nose but the base of the payload is restrained by the rim and is detached permitting the payload freedom to continue movement forward. It may be desirable, in some case, for the base to remain attached to the payload thus forming a stud or head preventing the payload from fully penetrating the target. Where the payload is a tracking device the aerial may then pass through the base to remain outside the target.

In this invention the flat front nose of the projectile provides a sufficiently large frontal area to arrest the progress of the projectile on impact without significant damage to a target following which the payload continues forward under inertia to penetrate the target.

A nose cone may be provided of aerodynamic ogival shape, which is relatively soft and squashes on impact preferably without significantly retarding the projectile velocity. In this construction it is the flat frontal area, which impacts the target to prevent penetration of the casing whilst permitting the payload to penetrate.

In a further construction the payload comprises a hollow lance or needle containing the substance to be injected and closed and sealed at the base by a cap or membrane. The base of the lance may include a fitting, which mechanically couples with the base of the cavity in the casing in manner permitting separation on application of a defined force. This fitting may be a series of pins or other formations which engage the base of the casing, or a part thereof, in the manner of a bayonet type of lock of which the pins fracture following target impact. The arrangement being such that the lance detaches and moves forward on target impact leaving the base portion in the casing. In this way the mass of the payload or lance is reduced following separation. In addition the configuration may be such that on missing a target or with a glancing impact the deceleration is insufficient to cause the lance to exit the casing. The complete projectile may then be recovered or biodegrade as a whole.

The penetration depth can be regulated by modifying the velocity for a given target species.

A membrane closure may be included over the open mouth of the cavity in the casing.

The casing may include preformed fracture zones sufficient to provide integrity on firing but allowing fragmentation following target impact. The casing will generally be biodegradable and this option provides a more rapid breakdown of the casing parts.

DETAILED DESCRIPTION OF THE FIGURES

Figure 1:
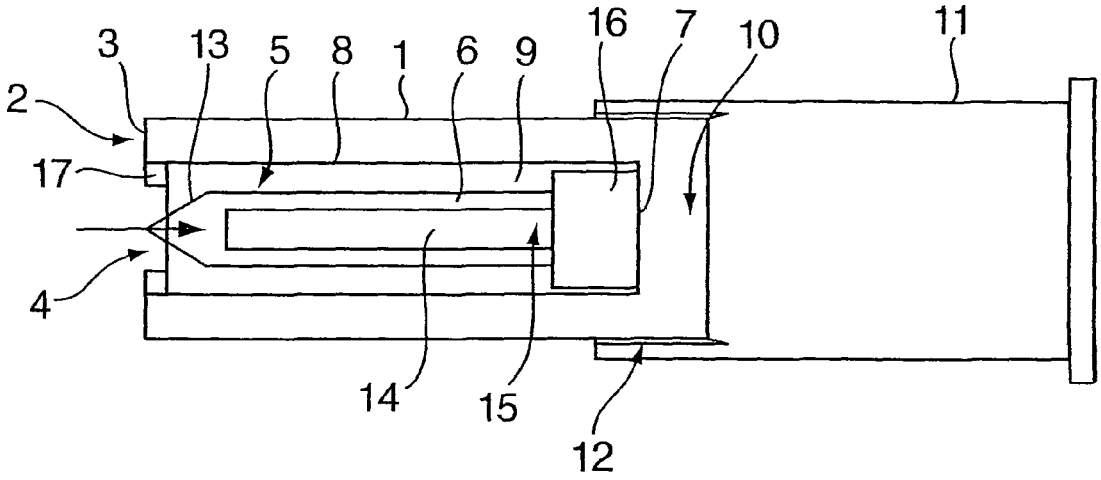
FIG. 1 shows a longitudinal cross-sectional view of the projectile in accordance with a first embodiment of the invention.

As shown in FIG. 1 cylindrical casing 1 has the one (nose) end 2 defined by a planar front face surface 3 with an opening 4 therein defining a cavity 5 extending longitudinally into the casing from said opening. A payload containing implant 6 is located within the cavity 5 bearing against the cavity base 7 and supported laterally by the cavity wall 8 through an intermediate powder material 9. The other (tail) end 10 of the cylindrical casing is adapted for connection with a propellant charge case 11.

The casing 1 includes a drive band or bands 12 serving to cooperate with the rifling of a barrel to impart spin to the projectile and to form an obturating means. The projectile may, alternatively, be sub-calibre supported by a propulsive cage or discarding sabot. In this embodiment the projectile is integrated with a propellant charge containing cartridge casing conveniently of twelve gauges.

The payload containing implant 6 comprises an elongate container with a pointed forward end 13 and adapted to house in cavity 14 an implant substance which may be a medicament. Alternatively, the payload container may itself be a soluble medicament.

The payload containing implant 6 has a diameter less than that of the cavity 8 and is laterally supported therein by a cage, of plastics for example, or by the powder or granular material 9. This material may include a marker dye and be of a kind, which is "fluidised" through energy release on impact of the projectile. This property being exhibited by finely comminuted materials such as "flour". Viscous fluid materials may be used of the kind, which fluidise on energy release being of a "thixotropic" nature.

The tail 15 of the payload containing implant 6 has a laterally extending base portion 16 which may be integral with the payload or a separate insert and the opening 4 in the casing 1 is reduced in diameter by an annular in-turned rim portion 17. The arrangement being such that on target impact, and through inertia, the payload containing implant 6 may pass through the reduced diameter opening 4 in the casing nose but the base 16 of the payload container is restrained by the rim and, if necessary, is detached permitting the container freedom to continue movement forward.

In this invention in a preferred embodiment the cylindrical casing 1 is of biodegradable plastics material or similar closed at the base end 10 and with integral drive bands 12 to both obturate and take the propulsive gases at launch. The casing has a cavity 4 inside the cylinder at the closed base is a solid disc of heavy biodegradable plastic or even metal. To this base is attached a pointed hollow needle 6 made from a rapidly soluble polymer that is not harmful when introduced into the muscle or fat of live animal and which is tough enough to penetrate the hide of a heavy animal. The needle will contain the medication in either powder or liquid form. Packed around the needle will be a powder 9 that will act as a solid in motion and support the needle. On impact the heavy disc 16 at the base moves forward as does the needle. The powder is forced out by the base 16 acting as a piston and becomes non solid and "liquid" on impact. The needle or implant with its medication payload penetrates the animal's hide and shears from the base disc as this is stopped by a rolled turnover/crimp 17 at the open end of the casing 1. Released from the momentum of the heavy base disc, the relatively light needle or implant penetrates only a few inches and comes to rest and begins to dissolve, releasing the medication. The packing powder will act both as a dye marker and an antibiotic with properties. The spent cylinder carries no needle or harmful residues and degrades rapidly. The packing medium 9 is ejected from the nose of the projectile and thus tends to form a fluid-like buffer, which, to some extent, tends to arrest and repel the casing 1.

By using the casing as a supporting discarding sabot and surrounding this with a packing powder to support the medication needle, high velocity launch can be achieved with far better range and accuracy. The twelve gauge calibre offers a large surface area so impact energy is well dispersed and from tests well tolerated at over 170 m/s on cattle, also on impact the projectile sheds weight and momentum rapidly in what is effectively a controlled disintegration and energy transfer on the surface of the hide.

A further, and perhaps more important advantage, is the safety aspect as the projectile houses no active devices and may be totally formed from a rapidly biodegradable material; an important feature as far as target "misses" are concerned. A biodegradable rigid plastics material is an option where a proportion of corn starch and polymer achieves the biodegradable properties.

Means other than a cartridge may be used to propel the projectile. In a further embodiment the tail of the projectile is adapted to cooperate with a compressed gas forming the means to propel the projectile along a barrel. The projectile may include a stabilising means at the tail end such as fins or "flights". For certain applications spring means may be utilised as a launching device.

Another embodiment incorporates a pressure gas capsule such as a so-called "micro sphere" containing a gas under extreme pressure and located behind the needle or implant to assist forward projection into a target. This may also be achieved using a small charge these devices being fired on impact. Means such as these reduce the forward momentum of the casing through the recoil action following firing.

The nose of the casing may be preformed so as to squash or collapse on impact. A separate nose attachment forms a feature of a further preferred embodiment. However, for most applications it has been found that the flat nose offers acceptable ballistic properties as far as range is concerned and, on impact, the casing tends to rebound from the hide of an animal which exhibits elastic properties when hit by the projectile travelling at a relatively high velocity.

In another embodiment the payload or implant comprises or houses a tracking device to be implanted in the target and the base of the tracking includes a laterally extending disc to arrest penetration with the rear of the disc having an antenna wire which is left extending from the target.

In summary therefore this invention provides a projectile for the delivery of a payload for implanting into a target the projectile having a cylindrical casing 1 with the nose end 2 defined by a planar front face surface 3 with an opening 4 therein defining a cavity 5 extending longitudinally into the casing. A payload containing implant 6 is located within the cavity 5 and bears against the cavity base 7 through a wider base support 16. The payload containing implant 6 is supported laterally by the cavity wall 8 through an intermediate powder material 9. The other end 10 of the cylindrical casing is adapted for connection with a propellant charge case 11. On target impact the payload containing implant 6 moves forward through inertia and base 16 is restrained by an in-turned rim 17 at the cavity opening 4. The flat front 3 reduces target damage on impact. The components are biodegradable.

Figure 2:
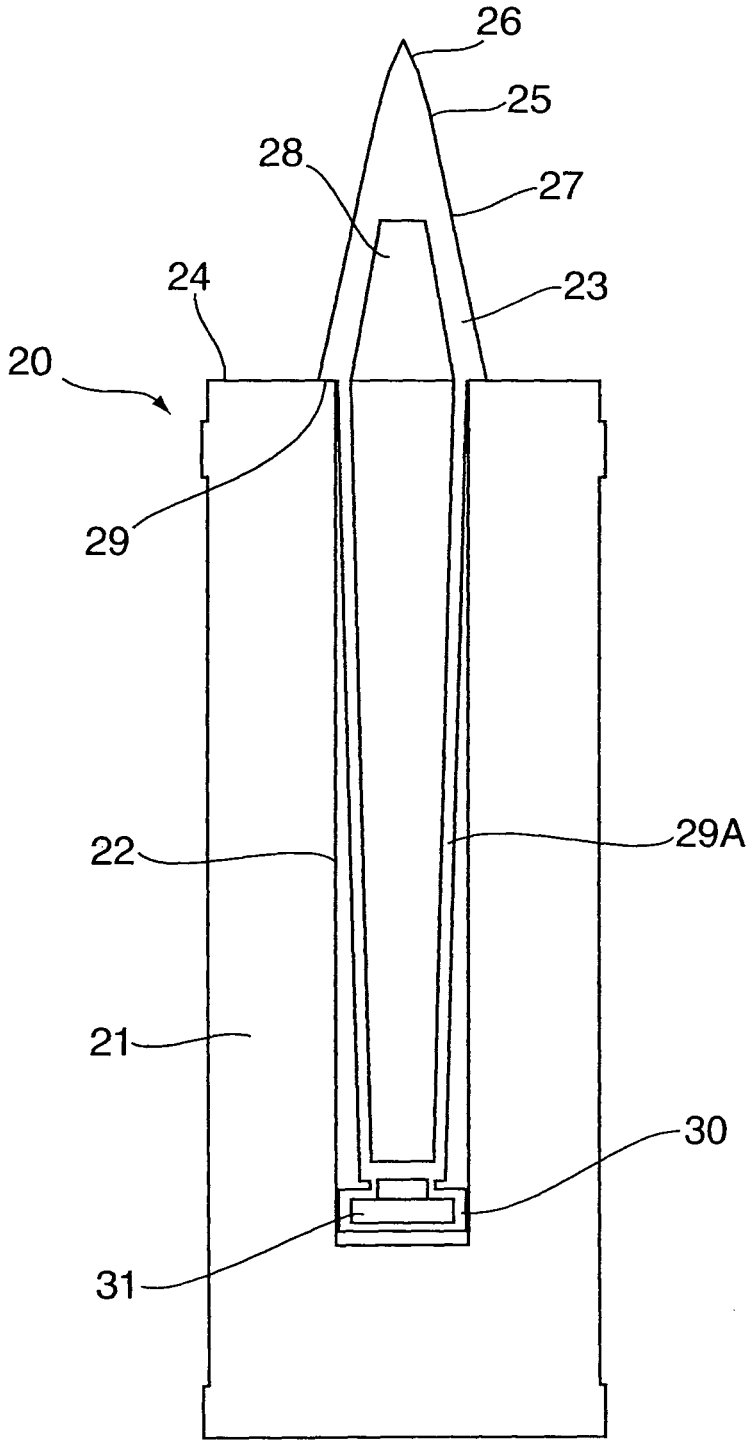
FIG. 2 shows a longitudinal cross-sectional view of a projectile with an implant, which is tapered from tip to tail in accordance with a second embodiment of the invention.

FIG. 2 shows a projectile generally referenced 20 with a sabot 21 being adapted to receive a propelling force. A cavity 22 accommodates an implant 23. Cavity 22 extends longitudinally from a front non-penetrating surface 24 of the nose of the projectile to a region of tail of the projectile. The implant 23 incorporates a substantially frusto-conical tip 25 with a forward most portion 26 and a second portion 27 which is located behind the forward most portion 26 which has a lower angle than the angle of the forward most portion. This tip itself incorporates a hollow portion 28, which is itself frusto-conical. In addition, the tip incorporates a flange 29 against which the front face 24 of the sabot abuts. The implant 23 or lance incorporates a central portion 29A of reducing diameter from the tip to the tail 30 of the implant. Tail 30 incorporates a disc-shaped portion 31, which sits flush against the wall of cavity 22. The gap between the implant 23 and sabot 21 may be empty or alternatively filled with a powder, gel or solid dye compound, which "fluidises" through energy release on impact of the projectile. Disc 31 is of sufficient diameter to cause the marker dye located in the cavity to be drawn out from the cavity as the implant separates from the sabot. The tail portion 30 of the implant may be itself of an antiseptic material. The antiseptic material may be of the form of a "thixotropic" nature. The tail may take the form of a blister containing a fluid which bursts on impact.

Figure 3:
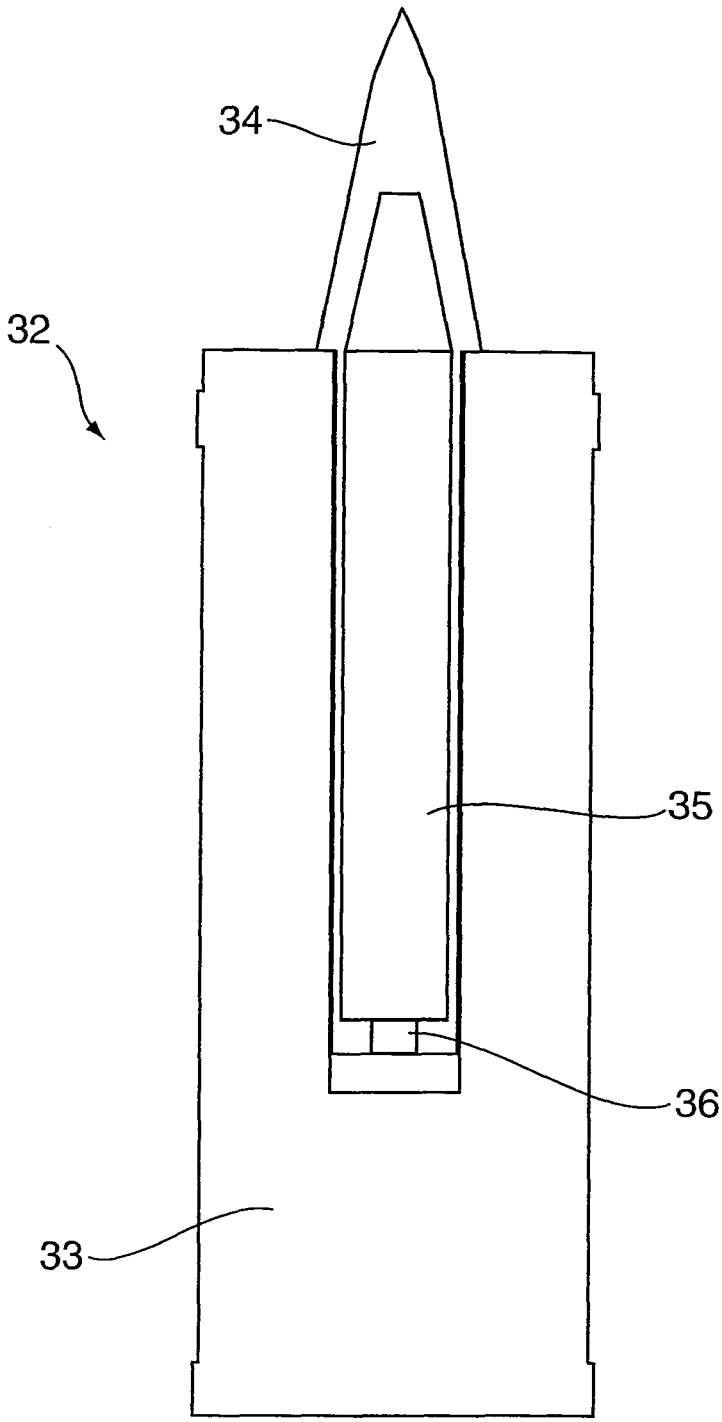
FIG. 3 shows a longitudinal cross-sectional view of a projectile where the body of the implant sits flush with the cavity wall of the sabot.

FIG. 3 shows a further projectile generally referenced 32 with a sabot 33 and an implant or lance 34. In this embodiment the implant incorporates a tip of the kind described in FIG. 2 with a central portion extending in the sabot's cavity, which snugly fits into the cavity. The implant incorporates a hollow portion 35 which may contain a medicament in fluid form, which can escape through aperture 36.

Figure 4:
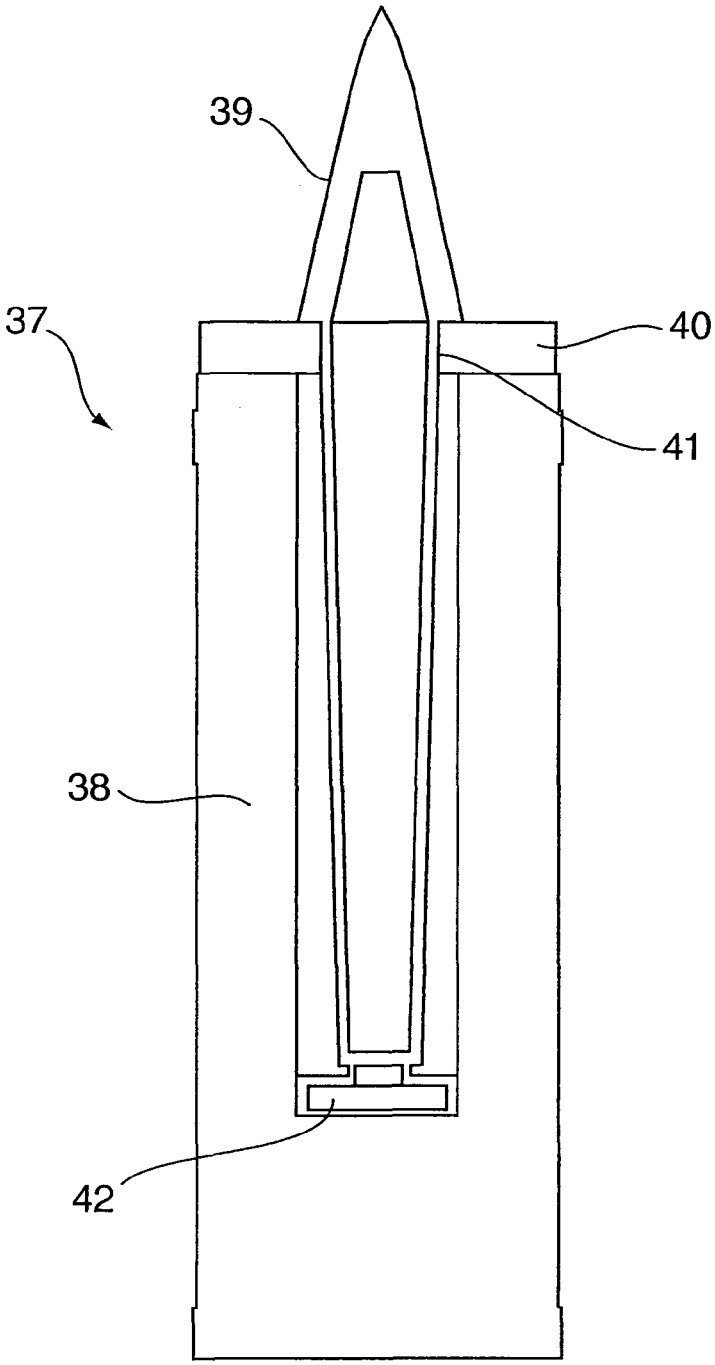
FIG. 4 is a longitudinal cross-sectional view of a projectile with a disc located at the front portion of the sabot.

FIG. 4 shows a projectile generally referenced 37 with a sabot 38 and an implant 39, which is of a similar configuration to the implant 23 of FIG. 2. On the front portion of the sabot 38, a disc 40 with a central opening 41 is provided allowing the implant to freely move from the position shown in FIG. 4 into a position where tail 42 would impact against the disc to separate the implant and disc combination from the sabot. The tail 42 incorporates itself a disc portion, which snugly fits into the cavity of the sabot. In order to facilitate the assembly of the disc onto the lance the disc may be a split disc.

Figure 5:
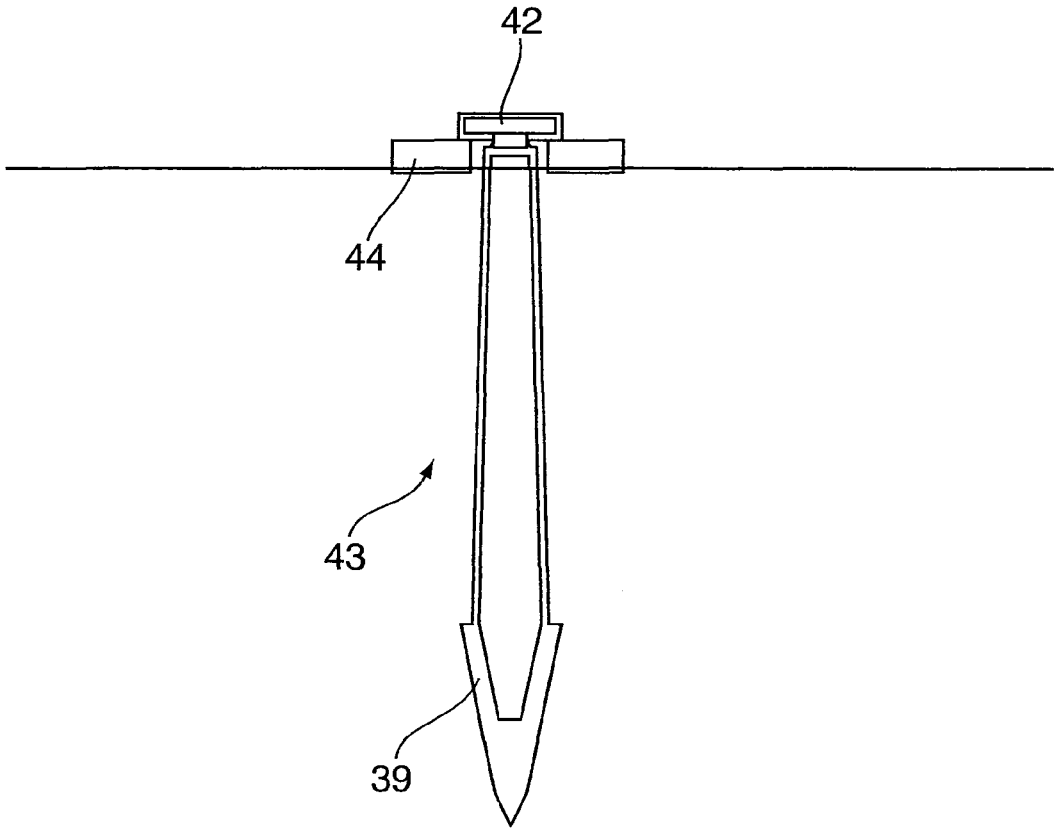
FIG. 5 shows a longitudinal cross-sectional view of the implant of FIG. 4 in its implanted position.

FIG. 5 shows implant 39 having exited the sabot 38 following impact. It is shown implanted into the animal hide 43 with disc 44 tightly located against the outside of the hide having been drawn from the sabot by tail 42. The disc may be itself a marker with or without an antiseptic property.

Figure 6:
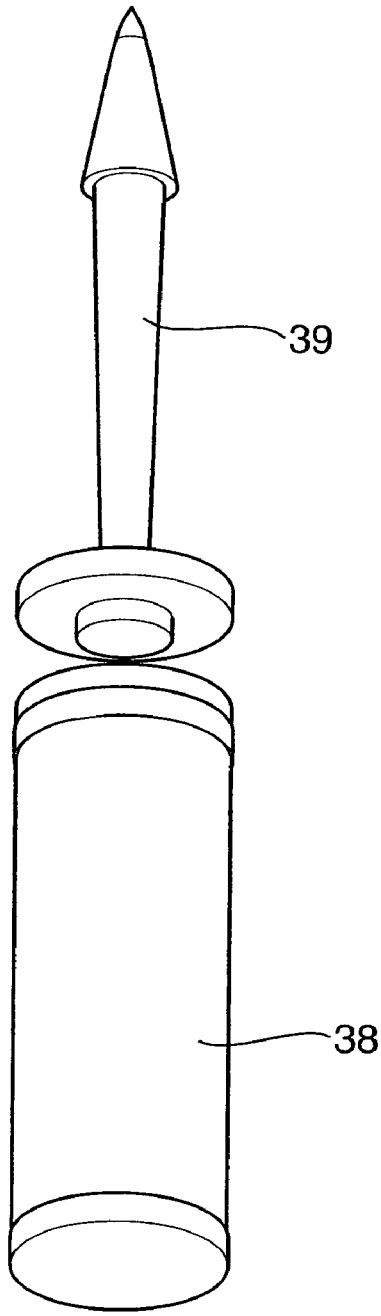
FIG. 6 shows a perspective view of a sabot and the implant after separation.

FIG. 6 shows sabot 38 and implant 39 side by side.

Figure 7:
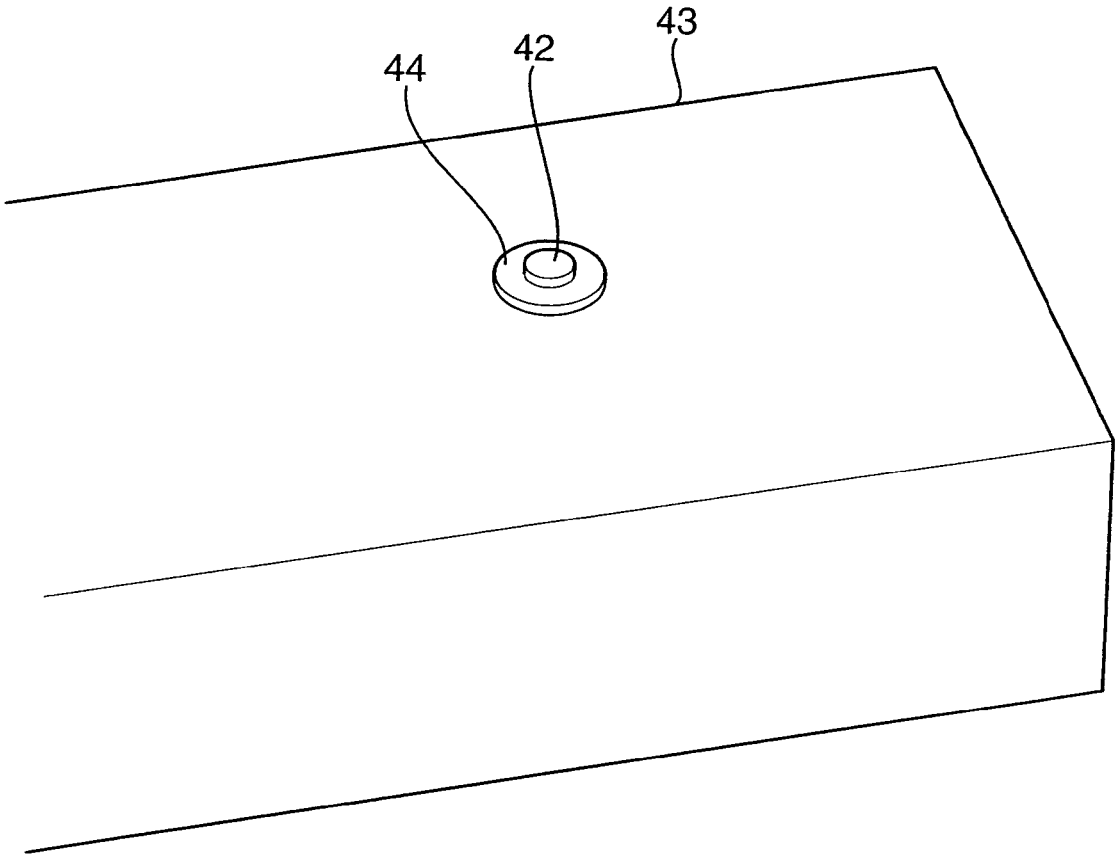
FIG. 7 shows an external view in perspective of a section of an animal with the implant implanted through its hide.

FIG. 7 shows head 42 and disc 44 protruding from the hide 43 of an animal.

Figure 8:
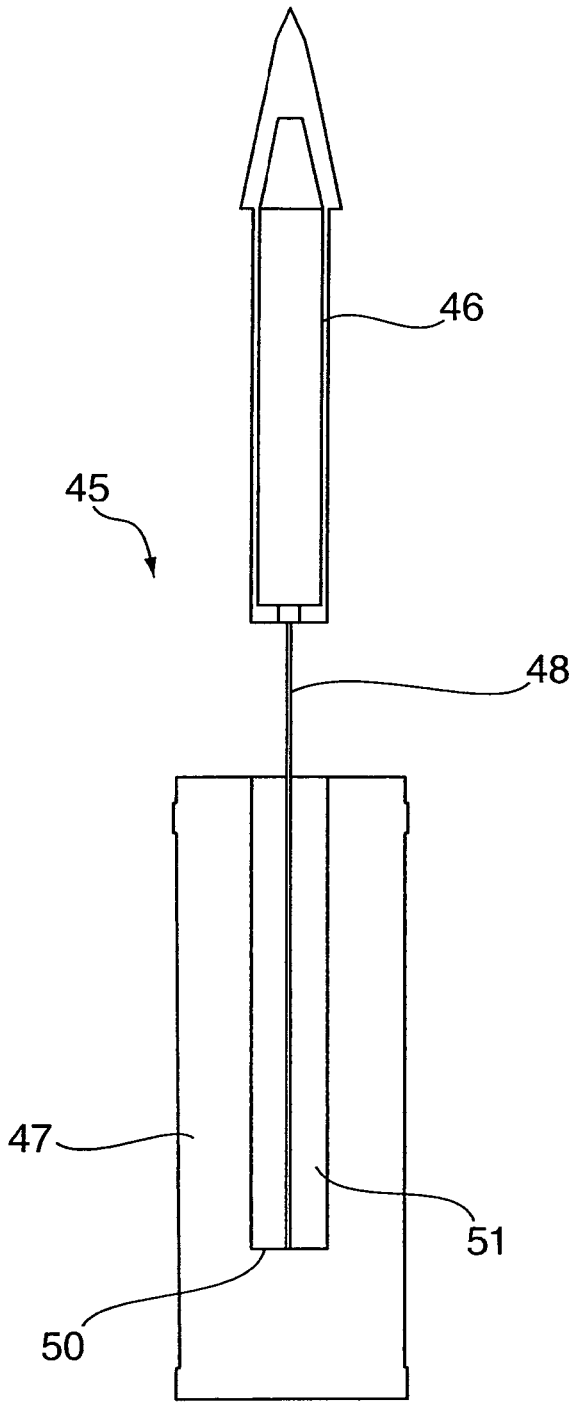
FIG. 8 shows a longitudinal cross-sectional view of a projectile with an implant in a form of lance and a sabot.

FIG. 8 shows a further projectile generally referenced 45 with an implant 46 in the form of lance and a sabot 47. A tether 48 for regulating the depth of the lance is provided between lance 46 and sabot 47. The tether is secured to the implant at its tail region whilst being secured to the base 50 of the cavity 51. The material employed for the tether may preferably be PVA or any other suitable dissolvable material.

Whilst the previous embodiments show an implant with an outside structure acting as a container and a payload located within the container, the invention envisages that the implant's structural components may be a solid combination of a medicament and a binding agent such as those used in aspirin pills. The portion of medicament and binding compound will be adjusted in order to achieve sufficient structural strength on impact for insertion of the implant into the hide of a given animal.

Embodiments 2-8 rely of the inertia of the implant for it to separate from the sabot and penetrate the target animal. The invention also envisages that optionally an extra detonator may be provided between the sabot and the tail of the implant to provide additional penetration force if necessary for certain applications.

What is claimed is:

1. A projectile including a cylindrical casing with the one nose end having a front face with an opening therein defining a cavity extending longitudinally into the casing from said opening, and the other tail end of the cylindrical casing being adapted to receive a propelling force; said projectile further comprising an implant incorporating a payload for penetrating a target on impact, wherein said implant is located at least in part within the cavity during flight and has longitudinal freedom of movement within the cavity towards the nose of the casing; whereby on impact said implant with its payload penetrates said target and is retained therein whilst said front face abuts at least momentarily said target and rebounds from said target; wherein said implant incorporates a pointed tip portion at its front followed by a body portion; both said tip and said body penetrate and are retained in said target; said pointed tip portion and said body portion being formed of materials which are degradable when implanted in said target; whereby said payload is released into said target.

2. A projectile in accordance with claim 1, wherein a membrane closure is included over the open mouth of the cavity in the casing.

3. A projectile in accordance with claim 1, wherein the casing includes preformed fracture zones sufficient to provide integrity on firing but allowing fragmentation following target impact.

4. A projectile in accordance with claim 1, wherein the casing includes a drive band or bands serving to cooperate with the rifling of a barrel to impart spin to the projectile and to form an obturating means.

5. A projectile in accordance with claim 1, wherein the projectile is sub-calibre supported by a propulsive cage or discarding sabot.

6. A projectile in accordance with claim 1, wherein the projectile is integrated with a propellant charge containing cartridge casing.

7. A projectile in accordance with claim 1, wherein the projectile incorporates a medicament or a tracking means or alternatively the implant may house such means and preferably will be soluble in a target.

8. A projectile in accordance with claim 1, wherein the implant has a diameter less than that of the cavity and is laterally supported therein by a cage, preferably of plastics material, or by a powder or granular material, which material may include a marker dye and may be of a kind which is "fluidised" through energy release on impact of the projectile.

9. A projectile in accordance with claim 1, wherein a gas producing means initiated on impact with a target is provided to assist in the forward inertia based movement of the implant.

10. A projectile according to claim 1, wherein said implant's tip portion is exposed during flight.

11. A projectile according to claim 10, wherein said exposed tip portion is carried by said front face of said casing.

12. A projectile according to claim 1, wherein said implant is separable from said casing.

13. A projectile according to claim 1, wherein said implant incorporates a hollow portion containing said payload.

14. A projectile according to claim 1, wherein said implant is substantially made of a medicament and a binding compound which constitute said payload.

15. A projectile according to claim 1, wherein said implant's tip is substantially frusto-conical.

16. A projectile according to claim 15, wherein said tip incorporates a forward most portion which is frusto-conical and a second portion which is frusto-conical located behind said forward most portion which has a lower angle than the angle of said forward most portion.

17. A projectile according to claim 1, wherein said implant incorporates a tail, a tip and a body located between said tail and said tip; said body being tapered so that the body is wider in the vicinity of its tip than it is at its tail.

18. A projectile according to claim 1, wherein a disc sits between the tip and the nose of said casing and said implant incorporates a tail which projects sideways in order to abut against said disc as the implant separates from said casing.

19. A projectile according to claim 18, wherein said disc is a marker.

20. A projectile according to claim 18, wherein said disc incorporates an antiseptic compound.

21. A projectile according to claim 1, wherein a tether extends between said casing and said implant.

22. A projectile according to claim 21, wherein said tether is biodegradable.

23. A projectile according to claim 1, wherein said casing is biodegradable.

24. A projectile in accordance with claim 1, wherein the tail end of the casing is adapted for connection with a propellant charge case.

25. A projectile in accordance with claim 1, wherein said implant has a diameter less than that of the cavity with support means interposed between the cavity wall and the implant.

26. A projectile in accordance with claim 1, wherein the implant bears against the base of the cavity through a laterally extending integral or separate rear part and the opening in the casing is reduced in diameter by an annular rim portion, the arrangement being such that on target impact, and through inertia, the implant may pass through the reduced diameter opening in the casing nose but the rear part of the implant is restrained by the rim and is arrested permitting the implant freedom to continue movement out of the cavity.

27. A projectile in accordance with claim 26, wherein said laterally extending rear part comprises a disc.

28. A projectile in accordance with claim 1, wherein said implant is a hollow implant containing the substance to be injected and closed and preferably sealed at the base by a cap or membrane.

29. A projectile in accordance with claim 1, wherein said implant incorporates a nose cone, which is provided of aerodynamic ogival shape and which is relatively soft and squashes on impact preferably without significantly retarding the projectile velocity.

30. A projectile in accordance with claim 1, wherein the base of the implant includes a fitting which mechanically couples with the base of the cavity in the casing in a manner permitting separation on application of a defined force.

31. A projectile in accordance with claim 30, wherein the fitting includes a series of pins or other formations which engage the base of the casing, or a part thereof, forming a mechanical lock which breaks following target impact or forming a bayonet type of lock of which the pins fracture following target impact.

* * * * *